United States Patent [19]

Rovner

[11] Patent Number: 5,018,425

[45] Date of Patent: May 28, 1991

[54] MOUTHPIECE SYSTEM FOR WOODWIND INSTRUMENTS

[76] Inventor: Philip L. Rovner, 10705 Cardington Way, Cockeysville, Md. 21030

[21] Appl. No.: 392,403

[22] Filed: Aug. 11, 1989

[51] Int. Cl.[5] ..... G10D 9/02

[52] U.S. Cl. ..... 84/383 R

[58] Field of Search ..... 84/383

[56] References Cited

U.S. PATENT DOCUMENTS

| | | | |
|---|---|---|---|
| 787,127 | 4/1905 | Starke | 84/383 |
| 1,060,946 | 5/1913 | Riday | 84/383 |
| 1,101,420 | 6/1914 | Erdahl | 84/383 |
| 1,411,563 | 4/1922 | Clark | 84/383 R |
| 1,467,524 | 9/1923 | Babbitt | 84/383 |
| 1,583,337 | 5/1926 | Chiron | 84/383 B |
| 1,771,109 | 7/1930 | Arthur | 84/383 R |
| 1,771,217 | 7/1930 | Grant | 84/383 |
| 1,801,421 | 4/1931 | Gemeinhardt | 84/383 |
| 2,003,576 | 6/1935 | Buhren | 84/383 |
| 2,648,246 | 8/1953 | Mueller | 84/383 |
| 2,837,003 | 6/1958 | Collis | 84/383 |
| 2,988,947 | 6/1961 | Houser | 84/383 R |
| 3,564,965 | 2/1971 | Carlini | 84/383 |
| 3,568,561 | 3/1971 | Gutstein | 84/383 |
| 3,618,440 | 11/1971 | Ratterree | 84/383 |
| 3,808,935 | 5/1974 | Reeves | 84/399 |
| 4,056,997 | 11/1977 | Rovner | 84/383 R |
| 4,185,535 | 1/1980 | Lorenzini | 84/383 R |
| 4,210,055 | 7/1980 | Platamone, Jr. | 84/383 R |
| 4,275,636 | 6/1981 | Van Doren | 84/383 R |
| 4,308,781 | 1/1982 | McGuerty | 84/383 R |
| 4,669,352 | 6/1987 | Bichon | 84/383 R |
| 4,745,838 | 5/1988 | Johnson | 84/383 R |

FOREIGN PATENT DOCUMENTS

| | | | |
|---|---|---|---|
| 702898 | 4/1931 | France | 84/383 |
| 1078574 | 11/1954 | France | 84/383 R |

OTHER PUBLICATIONS

Kinsler, Frey, Coppens and Sanders, "Fundamentals of Acoustics", third edition, pp. 200–205, 216–222 and 237–239.

*Primary Examiner*—Lawrence R. Franklin
*Attorney, Agent, or Firm*—Leonard Bloom

[57] ABSTRACT

An improved mouthpiece reed holder system for single-reed woodwind instruments. The mouthpiece window is nearly the full length of the reed such that preferably 65% or more of the area of the underside of the reed is open to the tone chamber. The associated reed holder (commonly termed the ligature) clamps the reed to the mouthpiece along the lateral edges of the reed. The tone chamber of the mouthpiece is preferably the same length as the window, and preferably rectangular or square in cross-section throughout its length. A hollow spoon shaped cavity communicates with the bore and the tone chamber and merges the bore with the tone chamber.

22 Claims, 3 Drawing Sheets

MOUTHPIECE SYSTEM FOR WOODWIND INSTRUMENTS

FIELD OF THE INVENTION

This invention relates to single-reed woodwind instruments and, more particularly, to a mouthpiece and interrelated reed holder for such instruments.

BACKGROUND OF THE INVENTION

The mouthpiece of a single-reed woodwind instrument is a device upon which the vibrating reed element is normally mounted to a surface of the mouthpiece, so that the tapered, less-thick end of the reed, being very flexible, functions as a reed valve. The reed, which opens and closes an opening in the mounting surface of the mouthpiece, is in oscillatory cooperation with the vibrating air column of the instrument. The opening, more commonly known as the window, normally is positioned relative to the reed and so sized such that only the underside of the reed in the region of the tapering segment of the reed interfaces with the air column of the instrument via the tone chamber portion of the mouthpiece. A survey was made of prior art and it was found that the length of the window never exceeded 57% of the length of the reed for the alto saxophone mouthpiece, and somewhat less than 57% for other types of saxophones and clarinets.

The remaining segment of the reed that is untapered, known as the heel of the reed, is normally clamped against the portion of the mounting surface of the mouthpiece, known as the table. The clamping is effected by means of a device known as a ligature. While conventional ligatures are typically configured on the premise that the heel of the reed is not actively associated with the generation of sound, a variety of ligature designs have been patented which recognize that the heel of the reed is an integral part of the vibrating system, and the manner in which the heel is restrained will influence the tonal character, the body of the sound, and the playing response of the reed/mouthpiece system. U.S. Pat. No. 2,837,003 issued to Collis discloses such a ligature which has four corner points exerting pressure on an intermediate portion only of the reed and the mouthpiece beneath the reed, permitting the reed to vibrate freely from air blown into the mouthpiece.

Another aspect of the design of the mouthpiece that influences tonal quality and playing response is the tone chamber and bore configuration. The tone chamber section of the mouthpiece is principally an acoustic transformer which converts the higher acoustic impedance at the tip of the mouthpiece to a lower impedance at the interface with the bore of the mouthpiece. Both the chamber and bore geometry can be configured in endless ways to achieve desired tonal colorations. One of the disadvantages of contemporary mouthpiece design is, that in an attempt to achieve certain tonal characteristics, proper impedance matching is often compromised, thus affecting power and response. Abrupt changes in cross-sectional area are often found, which reduce energy transfer through the region. Typically, the steep slope of some chambers or the abrupt expansion in cross-sectional area from the chamber to bore of other mouthpiece types, in conjunction with the bore-to-neck reduction in cross-section area of saxophone mouthpieces create a low-pass acoustic filter not unlike that of automobile mufflers or gun silencers. In the acoustic configuration of the prior art, it can be noted that such mouthpieces are typically configured with abrupt changes in cross-sectional areas or steep slopes in the chamber region. The enlargement formed by the bore of the mouthpiece between the end of the neck (leadpipe) and the abrupt reduction in cross-sectional area at the bore end of the chamber is what forms an acoustic filter. Such filtering induces a muffled tonal quality, reduces tonal dimension and projection, and diminishes the response of the instrument to the player.

While the design of mouthpiece chambers have been explored in countless ways, the bore has received little attention, typically having a straight or slightly tapered cylindrical geometry. This form of unidimensional geometry does not offer the more complex tonal color that is available with alternative geometries. As noted in the third edition of "Fundamentals of Acoustics" by Kinsler, Frey, Coppens, and Sanders published by Wiley, in Chapter 9, regarding resonance in pipes, cavities, and waveguides, the complexity of resonances for rectangular waveguides is greater than that for cylindrical waveguides.

SUMMARY OF THE INVENTION

It is an object of this invention to provide an improved mouthpiece for single-reed woodwind instruments, overcoming some of the problems and shortcomings of the prior art.

Another object of this invention is to provide a mouthpiece having improved tonal clarity, improved response, accuracy of intonation, power and ease of playing.

In accordance with the teachings of the present invention, there is disclosed a mouthpiece having improved tonal qualities capable of receiving a reed thereon to cause air to vibrate in a woodwind musical instrument. The mouthpiece includes a tapered front portion having a substantially flat one side. The one side has a table and an adjacent window having a given length. The table has a length which is relatively short with respect to the length of the window. The window has two sides. The mouthpiece has a tone chamber which is in communication with the window. The tone chamber extends the full length of the window. The mouthpiece further has a pair of facing rails, one rail on each side of the window, each rail extending the length of the window.

The reed has a length greater than the length of the window. The reed engages the facing rails such that the window extends to a substantial portion of the length of the reed and a substantial area of the reed interfaces with the tone chamber.

Means are provided for holding the reed on the mouthpiece.

The tone chamber has a cross section which is substantially rectangular such as to increase the spectral density of the harmonic overtones.

The mouthpiece further includes a tapered reduced rear portion which is adapted to fit to the woodwind instrument in a conventional manner. The rear portion has a bore therein, the bore having a length necessary to telescopically receive a neckpiece of the woodwind instrument.

The mouthpiece further has a shallow spoon shaped cavity which communicates with the bore and the tone chamber and merges the bore into the tone chamber.

In a preferred embodiment, the bore has a longitudinal axis and the spoon shaped cavity has walls which form an angle not to exceed 15° with respect to the longitudinal axis of the bore. In this manner, abrupt sharp changes in cross section that cause impedance discontinuities, energy reflection and acoustical filtering are reduced.

The reed has an underside, a heel and lateral edges on the heel. The means for holding the reed on the mouthpiece is a ligature. The ligature has a body extending around the mouthpiece and a means for adjusting the body about the mouthpiece to secure the reed thereto. The ligature is mounted on the reed such that the adjusting means is adjacent to the reed. The ligature applies pressure only to the lateral edges of the heel of the reed, such that a predominant portion of the underside of the reed is unconstrained from vibration and is in contact with the vibrating air in the tone chamber of the mouthpiece. This provides increased interchange of acoustic energy between the tone chamber and the heel of the reed.

Viewed in another aspect, there is herein illustrated and described a mouthpiece having improved tonal qualities capable of receiving a reed thereon to cause air to vibrate in a woodwind instrument. The mouthpiece includes, in combination, a front portion having a substantially flat side. The side has a table and an adjacent window having a given length, the table having a length which is relatively short with respect to length of the window. The reed has a length greater than the length of the window. The window extends a substantial portion of the length of the reed. The reed is received on the side of the front portion of the mouthpiece and covers the window. The reed has side edges thereon. Clamping means are provided to retain the reed on the mouthpiece. The clamping means exert a transverse clamping pressure against the side edges of the reed. The front portion of the mouthpiece has a tone chamber which is in communication with the window. The mouthpiece further has a rear portion which has a longitudinal opening formed therein which is in smooth communication with the tone chamber such that the transition therebetween is devoid of discontinuities.

Still other objects of the present invention will become readily apparent to those skilled in this art from the following description, wherein there is shown and described a preferred embodiment of this invention. Simply by way of illustration, the invention will be set forth in part in the description that follows and in part will become apparent to those skilled in the art upon examination of the following or may be learned with the practice of the invention. Accordingly, the drawings and descriptions will be regarded as illustrative in nature and not as restrictive.

DESCRIPTION OF THE PREFERRED EMBODIMENT

Figure 1:
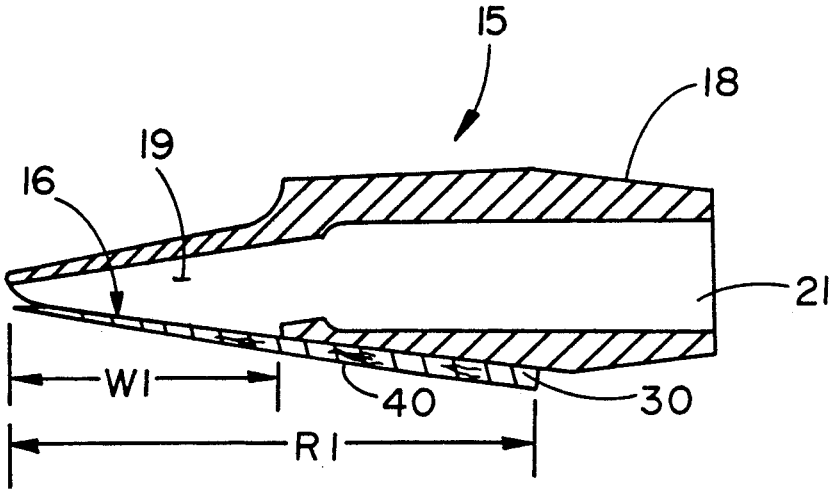
FIG. 1 PRIOR ART
FIG. 1 is a cross-sectional view of a saxophone mouthpiece in accordance with the prior art.
Figure 2:
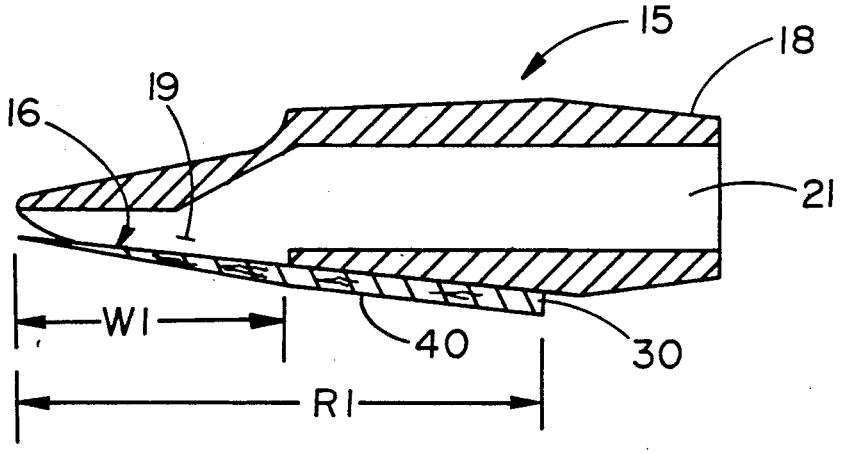
FIG. 2 PRIOR ART
FIG. 2 is a cross-sectional view of a saxophone mouthpiece in accordance with the prior art.
Figure 3:
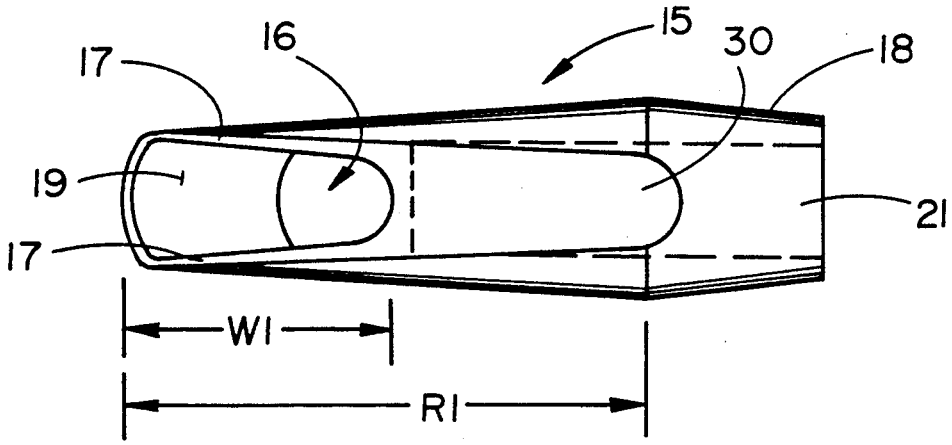
FIG. 3 PRIOR ART
FIG. 3 is a bottom view of a saxophone mouthpiece in accordance with the prior art.

Referring to FIGS. 1-3, the prior art show the reed length (Rl) and the window length (Wl) in which the window length (Wl) does not exceed 57% of the reed length (Rl).

Figure 4:
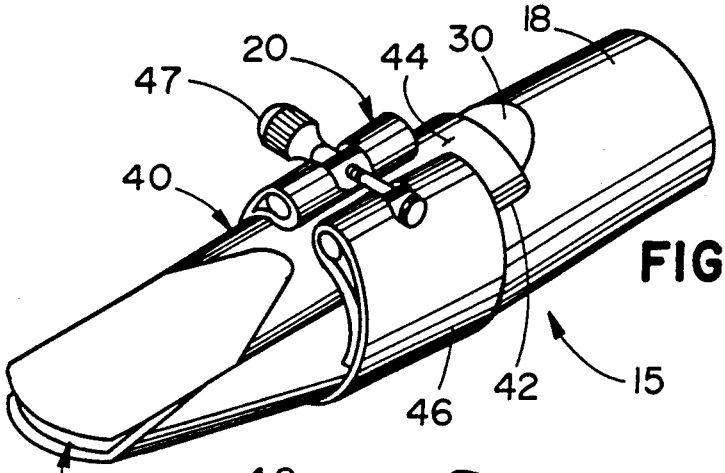
FIG. 4 is a perspective view of the device of the present invention.

Referring to FIG. 4, the mouthpiece 15 is of a generally cylindrical shape having a tapered front portion which is substantially flat on one side and a tapered, reduced rear portion 18 which is adapted to fit to the instrument in a conventional manner. The flat side of the front portion comprises a window 16 and a table 30. The mouthpiece 15 has a tone chamber 19 in the front portion and the tone chamber 19 is in communication with the window 16. A reed 40 extends over the window 16 and part of the table 30 of the mouthpiece 15, and is held to the mouthpiece 15 with a ligature 20. There is a longitudinal opening, a bore 21 through the rear portion 18 of the mouthpiece 15.

This invention is an improved mouthpiece 15/ligature 20 system whereby the objectives mentioned heretofore are collaboratively adjoined to overcome the shortcomings and problems of the prior art. The chamber expansion ratio has been reduced to minimize the coefficient of energy reflection. The interface between the chamber 19 and bore 21 is free from abrupt, sharp changes in cross-section. The table area 30 for the reed 40 has been reduced by extending the length of the window 16 to a substantial portion of the length of the reed 40. The premise for extending the window 16 derives from a discovery made during the course of an experiment. In an attempt to brighten the tone color, four mouthpieces were fabricated with successively smaller windows and chambers than as in the prior art. It was found that even though the tonal color did in fact become somewhat brighter with each decrease in the length of the window 16, the character of the sound became increasingly muffled or less clear. Successive increases in the length of the window greater than that of the prior art led to successive increases in tonal clarity. This effect was noticeable up to the point where the length of the window 16 approximated 85% the length of the reed 40 and the uncovered area of the underside of the reed 40 approximated 65% of the total reed area. In addition, it was found that the response and power increased as well.

Therefore, the length of the window 16 in this invention can extend from 58% to 98% of the overall length of the reed 40, but in the preferred embodiment, the window length is 85% of the reed length.

Figure 5:
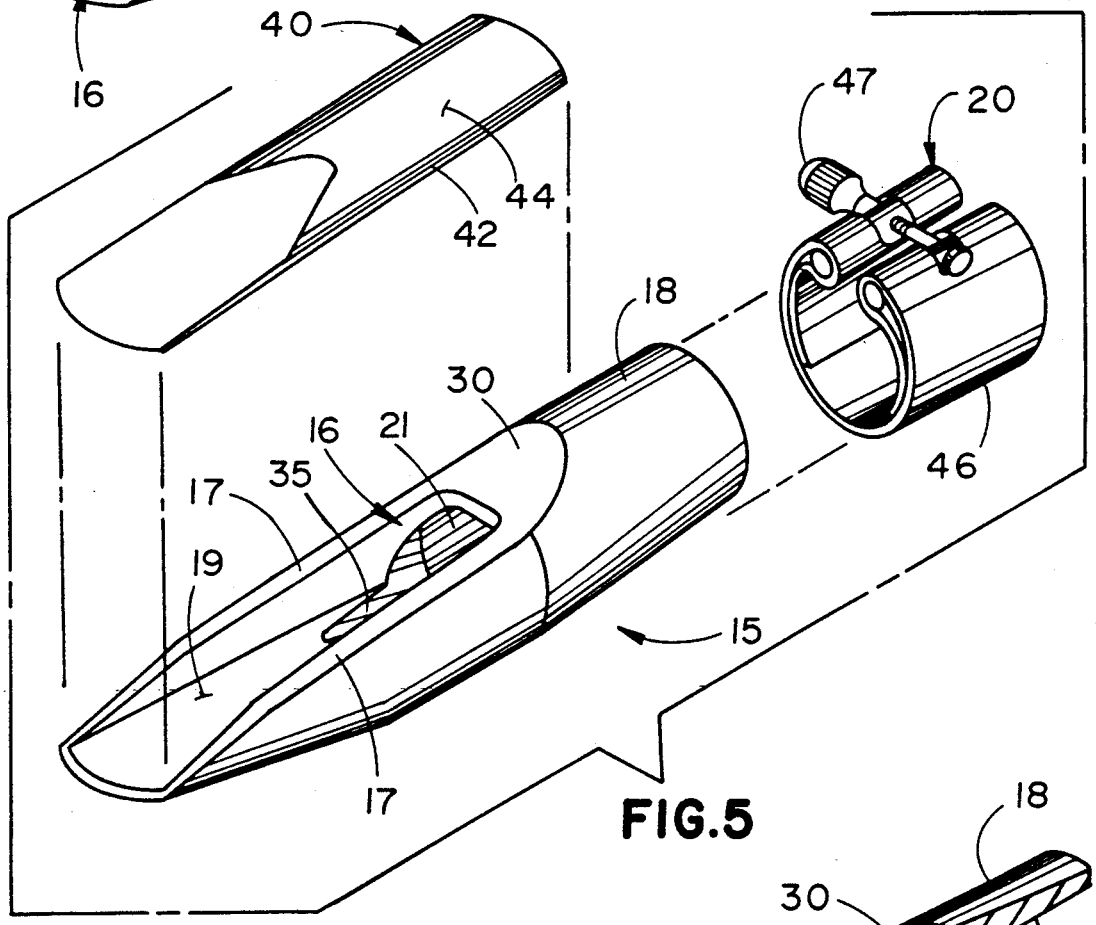
FIG. 5 is an exploded perspective view of the device of the present invention showing the reed, the mouthpiece and the ligature.
Figure 6:
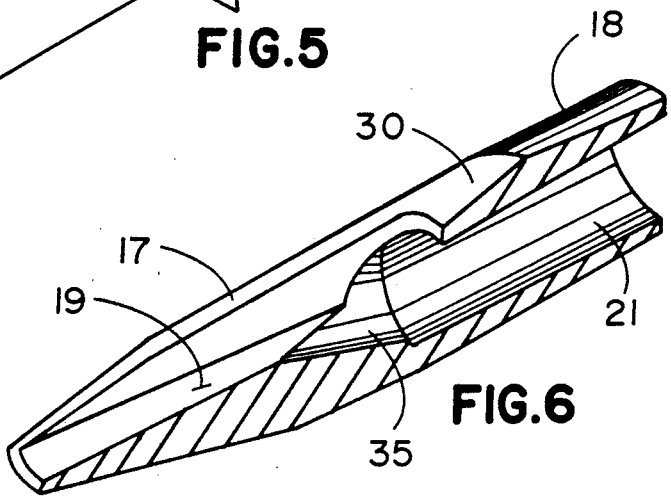
FIG. 6 is a cross-sectional view of FIG. 5 showing the merging of the tone chamber with the bore by the spoon shaped cavity.
Figure 7:
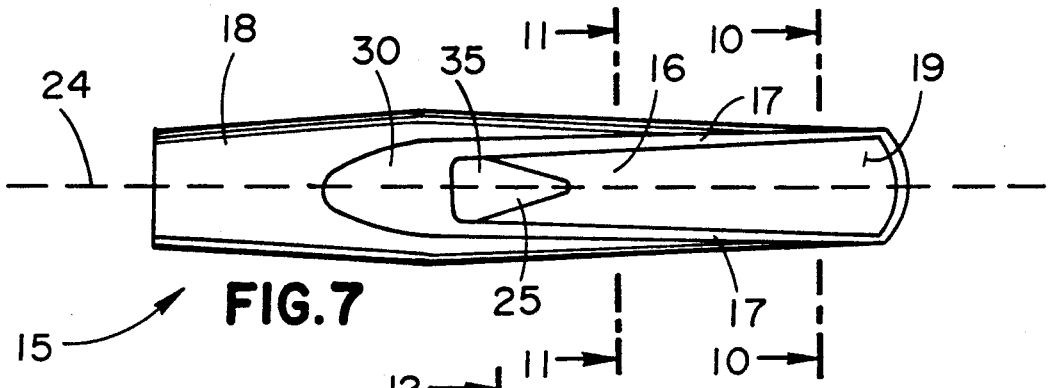
FIG. 7 is a bottom view of a saxophone mouthpiece showing the window, table, tone chamber and spoon shaped cavity in accordance with this invention.

Referring to FIGS. 5 and 6, the mouthpiece 15 of the present invention is shown with the reed 40 and ligature 20 removed. The window 16 is seen to be extended in length nearly to the rearward end of the facing rails 17 upon which the reed 40 is normally affixed. Referring additionally to FIGS. 5 to 8, it can be noted that the tone chamber 19 is also extended in length as compared to that of the prior art.

By extending the length of the window 16 to a substantial portion of the length of the reed 40, it now becomes practicable to change most of the normally circular bore 21 of the mouthpiece 15 to that of a rectangular cross-section. As noted heretofore, Kinsler, Frey, Coppens, and Sanders teach that the overtone spectrum associated with a cylindrical waveguide is not as complex as those associated with a rectangular waveguide. Therefore it can be understood that if a richer tonal quality is desired, a rectangular waveguide is a preferred geometry for the chamber and bore of the mouthpiece. Only the portion of the bore 21 that telescopically receives the neck or lead pipe of the instrument is circular in cross-section.

Figure 8:
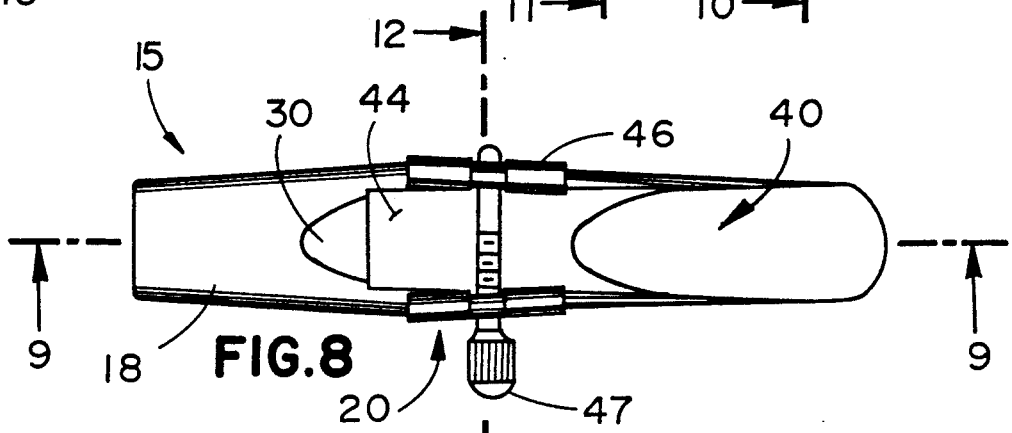
FIG. 8 is a bottom view of FIG. 7 showing the reed mounted on the mouthpiece with the ligature.
Figure 9:
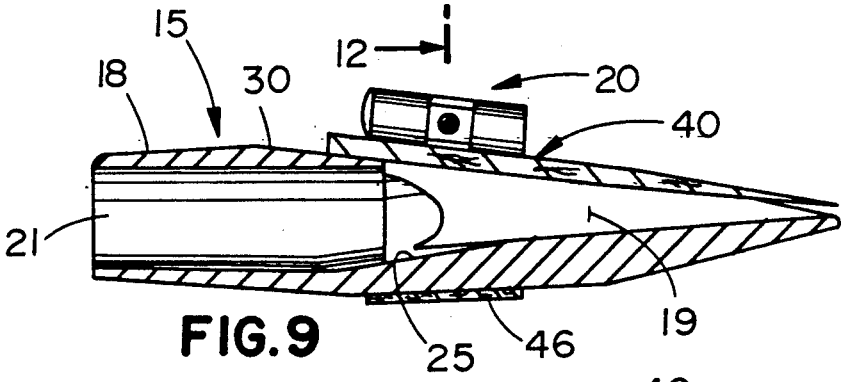
FIG. 9 is a cross-sectional view of the mouthpiece taken along the lines 9—9 of FIG. 8 showing the tone chamber of the invention.
Figure 10:
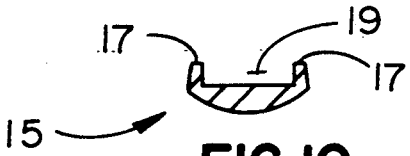
FIG. 10 is a cross-sectional view of a saxophone mouthpiece taken along the lines 10—10 of FIG. 7 showing the region beneath the tapered section of the reed in accordance with this invention.
Figure 11:
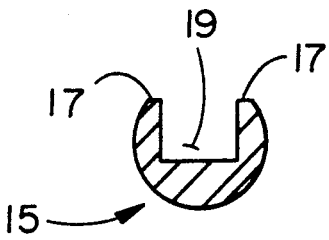
FIG. 11 is a cross-sectional view of the mouthpiece taken along the lines 11—11 of FIG. 7 showing the tone chamber and bore in accordance with this invention.
Figure 12:
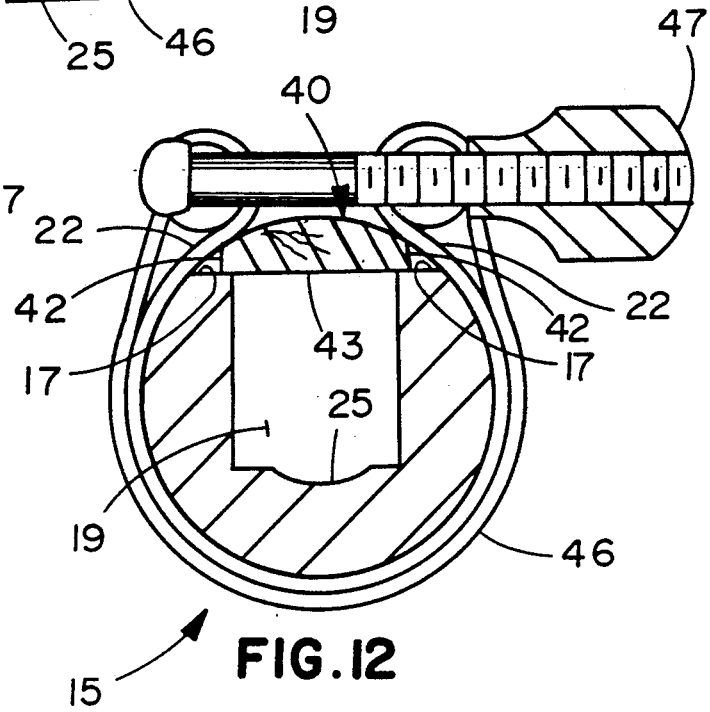
FIG. 12 is an enlarged cross-sectional view of the mouthpiece taken along lines 12—12 of FIG. 8 showing the reed and ligature assembly mounted about the mouthpiece showing the spoon shaped cavity and the tonal chamber in accordance with this invention.

In FIGS. 8 and 9, the bore 21 will be seen to be shortened to only that length necessary to accommodate the length of the telescopically received neckpipe of the associated instrument. FIGS. 10 to 12 illustrate the cross-sectional geometry of the mouthpiece 15 of the invention, whereby it can be noted how the cross-sectional geometry of the tone-chamber 19 remains rectangular in the region normally occupied by the circular cross-section of the bore 21 of the prior art. The pair of side walls of the tone chamber 19 are substantially parallel to one another and are substantially perpendicular to the base of the tone chamber 19. The base of the tone chamber is opposite to the window 16. Extending the tone chamber 19 and window 16 to a substantial portion of the length of the reed 40 in this manner (unlike the prior art) permits a substantial area of the reed 40 to interface with the air in the chamber 19 of the mouthpiece 15. Therefore, when the reed 40 and air in the instrument are in oscillatory vibration, an increase in energy interchange between the reed 40 and the air will take place, producing greater volume, greater tonal clarity, and better response. In FIGS. 5, 6, 7, 9 and 12, it can be noted how the tone-chamber 19 and bore 21 are smoothly joined with minimal abruptness via a shallow spoon-shaped cavity 35 that merges the rectangular cross section of the tone-chamber 19 into the circular cross section of the bore 21. The cavity 35 is a transition region in a V-shape, narrower toward the tone chamber 19 and wider toward the bore 21. In this manner the present invention eliminates the abrupt changes in cross section that cause impedance discontinuities, energy reflection and acoustical filtering. The cavity 35 has side walls 25 extending toward the window 16 of the mouthpiece 15. The angle of the walls 25 of the cavity 35 is preferably 15 degrees or less with respect to the longitudinal axis 24 of the bore 21 of the mouthpiece. For energy propagation along the axis of the bore 24, Kinsler, Frey, Coppens, and Sanders teach, in the aforementioned text, that the reflection coefficient will be a function of the cosine of the oblique angle of incidence between the wave and the solid surface. For angles of 15 degrees or less, this will be found to be 3.4% or less, or negligible for practical circumstances.

The ligature 20 is configured to clamp the reed 40 in position against the mouthpiece 15 by clamping only along the side, lateral edges 42 of the reed 40. The band 46 of the ligature 20 is positioned to extend around the mouthpiece 15. The adjusting means 47 of the ligature 20 is positioned adjacent to the reed 40. This is contrary to the conventional positioning of the ligature 20. Conventionally, the band 46 contacts the reed 40 and the adjusting means is on the opposite side of the mouthpiece 15 from the reed 40. Pressure is applied to the reed 40 in opposition to the facing rails 17 of the lengthened window 16, thereby effecting the clamping of the ligature 20 in an efficacious manner for good sealing. Because of the decrease in the area of the surface upon which the reed 40 is supported, the ligature 20 imparts a greater unit area of sealing pressure to the reed 40. When used with cane reeds, which are the most popular type, the facing rails 17 of the window 16 indent slightly into the underside of the reed 40, enabling more positive sealing to take place than in the case where the greater, more distributed area of a convention table 30 is used.

The preferred embodiment for the ligature is depicted in FIG. 12. This configuration is an inverted installation of the preferred embodiment of U.S. Pat. No. 4,056,997, issued to Rovner. Clamping pressure on the reed 40 through a layer of rubberized fabric 22, interposed between the adjusting means of the ligature 20 and the reed 40, is applied transversely against its side edges to minimize deformation of the reed 40 into the chamber. This deformation could occur if the pressure was applied equally over the heel 44 of the reed 40 or upon the central portion of the heel 43. Applying pressure on only the side edges 42 of the heel of the reed 40 permits deflection to take place in the central region of the heel upon the application of acoustic energy from the tone chamber 19 of the mouthpiece, thereby allowing the heel 44 of the reed 40 to increase the interchange of energy that takes place between the reed 40 and the air, over that which occurs in the prior art. The advantage of this ligature 20 embodiment (over that of others which support the reed by its lateral edges or discrete pressure points) is the interposition of a layer of damping 22 between the reed and the adjusting means. This damping layer 22 absorbs and terminates vibrating energy from the reed 40 so as to subdue the internal resonances of the reed 40. Doing so enables the reed 40 to vibrate more in cooperation with the air column vibrations of the instrument, thereby creating a tonal character of greater musicality.

An additional benefit of this method of mounting the reed 40 is that it allows lateral warping of the heel of the reed 40 to take place without tending to reduce the efficacy of the air seal between the reed 40 and the mouthpiece 15 just in front of the front edge of the ligature 20. Typically, lateral warping of the reed occurs when the moisture content of the region of the cane near the surface of the bark has not reached the same level as the body of the cane at the flat underside of the reed. As the reed 40 bows such that the flat underside becomes convex, the lateral edges forward of the ligature 20 tend to lift from the side rails 17 of the mouthpiece 15 as a result of the pressure of the center of the reed pressing on the table 30 as in the prior art. With the removal of the center of the table 30 in this invention, lateral bowing of the reed 40 is not detrimental to the air seal formed between the reed 40 and the side rails 17 of the mouthpiece 15 thereby improving the reliability and consistency of reed 40 performance.

Therefore, a new, novel and unobvious mouthpiece 15 and ligature 20 system has been described which incorporates a combination of a mouthpiece 15 having an extended window 16, a shortened table 30, an extended chamber 19, means of merging the chamber 19 with the bore 21 and a ligature 20 design which enables the reed 40 to be clamped to this unique mouthpiece 15 such that the reed 40 function is enhanced. Increased tonal coloration and brilliance, with greater tonal body and solidity, improved projection, power and response are some of the more obvious beneficial manifestations of this invention.

While the invention has been described with reference to a preferred embodiment, it would be obvious to one skilled in the art that modifications and variations of the invention may be constructed and employed without departing from the scope of the invention as defined in the following claims.

What is claimed is:

1. A mouthpiece having improved tonal qualities capable of receiving a reed thereon to cause air to vibrate in a woodwind musical instrument, comprising, in combination:

a tapered front portion having a substantially flat one side thereon, the one side having a table and an adjacent window having a given length, the table having a length which is relatively short with respect to the length of the window, the window having two sides;

the front portion having a tone chamber, the tone chamber in communication with the window, the tone chamber extending the full length of the window;

a pair of facing rails, one rail on each side of the window, each rail extending the length of the window;

the reed having a length greater than the length of the window, the reed engaging the facing rails such that the window extends to at least approximately 70% of the length of the reed, said length of the reed interfacing with the tone chamber; and means for holding the reed on the mouthpiece.

2. The mouthpiece of claim 1, wherein the tone chamber has a cross section, the cross section being substantially rectangular such as to increase the spectral density of the harmonic overtones.

3. The mouthpiece of claim 1, further comprising a tapered reduced rear portion adapted to fit to the woodwind instrument in a conventional manner; the rear portion having a bore therein, the bore having a length necessary to telescopically receive a neckpiece of the woodwind instrument.

4. The mouthpiece of claim 3, wherein a shallow spoon shaped cavity communicates with the bore and the tone chamber and merges the bore into the tone chamber, the cavity being V-shaped, being narrower toward the tone chamber and wider toward the bore.

5. The mouthpiece of claim 4, wherein the bore has a longitudinal axis and the spoon shaped cavity has walls which form an angle not to exceed 15° with respect to the longitudinal axis of the bore, such that abrupt changes in cross section that cause impedance discontinuities, energy reflection and acoustical filtering are reduced.

6. The mouthpiece of claim 1, wherein the length of the window is approximately 85% of the length of the reed.

7. The mouthpiece of claim 1, further comprising the reed having an underside, a heel and lateral edges on the heel; the means for holding the reed on the mouthpiece being a ligature, the ligature having a body extending around the mouthpiece and a means for adjusting the body thereabout to secure the reed to the mouthpiece, the ligature being mounted on the reed such that the adjusting means is adjacent to the reed such that the ligature applies pressure only to the lateral edges of the heel of the reed.

8. The mouthpiece of claim 7, wherein the heel of the reed has a width and less than 50% of the width of the heel is in pressure contact with the ligature.

9. The mouthpiece of claim 7, wherein the body of the ligature is constructed of an energy absorbing material, the energy absorbing material of the body of the ligature being placed in pressure contact with the lateral edges on the heel of the reed so that vibrational energy in the reed is terminated by the ligature.

10. In a woodwind musical instrument having a mouthpiece capable of receiving a reed thereon, means for holding the reed on the mouthpiece, the mouthpiece having a tapered front portion, the tapered front portion having a substantially flat one side, the one side having a window therein, the mouthpiece having a tone chamber in communication with the window, the improvement therein in combination, comprising:

the tone chamber having a substantially rectangular cross section;

the mouthpiece having a tapered rear portion, the rear portion having a substantially circular cross section bore therein; and the mouthpiece having a shallow spoon shaped cavity, the cavity being V-shaped, being narrower toward the tone chamber and wider toward the bore, the cavity communicating with and merging the circular cross section bore and the rectangular cross section tone chamber such that abrupt changes in cross section are eliminated thereby reducing impedance discontinuities, energy reflection and acoustical filtering.

11. The improvement of claim 10, wherein the bore has a longitudinal axis and the spoon shaped cavity has walls which form an angle not to exceed 15° with respect to the longitudinal axis of the bore.

12. A mouthpiece for a woodwind musical instrument having improved tonal qualities, and comprising, in combination:

a front portion having a substantially flat side thereon, the side having a table and an adjacent window having a given length, the table having a length which is relatively short with respect to the length of the window;

a vibrating reed on the side of the front portion of the mouthpiece and covering the window, the reed having a length greater than the length of the window, the window extending at least approximately 70% of the length of the reed, the reed having side edges thereon;

clamping means for retaining the reed on the mouthpiece, the clamping means exerting a transverse clamping pressure against the side edges of the reed;

the front portion of the mouthpiece having a tone chamber in communication with the window; and a rear portion having a longitudinal opening formed therein in smooth communication with the tone chamber, such that the transition therebetween is devoid of abrupt discontinuities.

13. In a woodwind musical instrument having a mouthpiece capable of receiving a reed thereon, means for holding the reed on the mouthpiece, the mouthpiece having a tapered front portion, the tapered front portion having a substantially flat one side thereon, the one side having a table and an adjacent window having a given length, the mouthpiece having a tone chamber, the improvement therein in combination, comprising the table having a length which is relatively short with respect to the length of the window, the window extending to at least approximately 70% of the length of the reed, the window being in communication with the tone chamber in the mouthpiece such that said length of the reed interfaces with the tone chamber;

the tone chamber having a substantially rectangular cross section;

the mouthpiece having a tapered rear portion, the rear portion having a substantially circular cross section bore therein; and the mouthpiece having a shallow spoon shaped cavity communicating with and merging the circular cross section bore and the rectangular cross section tone chamber, the cavity being V-shaped, being narrower toward the tone chamber and wider toward the bore such that abrupt changes in cross section are eliminated thereby reducing impedance discontinuities, energy reflection and acoustical filtering.

14. The mouthpiece of claim 13, further comprising the reed having an underside, a heel and lateral edges on the heel; the means for holding the reed on the mouthpiece being a ligature, the ligature having a body extending about the mouthpiece and a means for adjusting the body thereabout to secure the reed to the mouthpiece, the ligature being mounted on the reed such that the adjusting means is adjacent to the reed, a damping layer being disposed between the lateral edges of the reed and the adjusting means, such that the ligature applies pressure only to the lateral edges of the heel of the reed, such that a predominant portion of the underside of the reed is unconstrained from vibration and is in contact with the vibrating air in the tone chamber of the mouthpiece thereby increasing interchange of acoustic energy between the tone chamber and the heel of the reed.

15. The improvement of claim 13, wherein the bore has a longitudinal axis and the spoon shaped cavity has walls which form an angle not to exceed 15° with respect to the longitudinal axis of the bore.

16. The improvement of claim 13, further comprising the window having two sides and a length, each side of the window having a facing rail extending the length of the window; the reed having an underside and lateral edges, the lateral edges of the reed engaging the facing rails, a predominant portion of the underside of the reed being in contact with the vibrating air in the tone chamber.

17. The improvement of claim 13, wherein the length of the window is approximately 85% of the length of the reed.

18. A mouthpiece having improved tonal qualities capable of receiving a reed thereon to cause air to vibrate in a woodwind musical instrument, comprising, in combination:

a tapered front portion having a substantially flat one side thereon, the one side having a table and an adjacent window having a given length, the table having a length which is relatively short with respect to the length of the window, the window having two sides;

the front portion having a tone chamber, the tone chamber in communication with the window, the tone chamber extending the full length of the window;

a pair of facing rails, one rail on each side of the window, each rail extending the length of the window;

the reed having a length greater than the length of the window, the reed engaging the facing rails such that the window extends to at least approximately 70% of the length of the reed, said length of the reed interfacing with the tone chamber;

resilient means for holding the reed on the mouthpiece wherein the reed has a heel and lateral edges on the heel, the resilient means applying clamping pressure transversely against the lateral edges of the heel of the reed permitting the heel of the reed to be deflected upon vibration of air in the tone chamber.

19. The mouthpiece of claim 18, wherein the tone chamber has a cross section, the cross section being substantially rectangular.

20. In a woodwind musical instrument having a mouthpiece capable of receiving a reed thereon, means for holding the reed on the mouthpiece, the mouthpiece having a tapered front portion, the tapered front portion having a substantially flat one side, the one side having a window therein, the mouthpiece having a tone chamber, the window being in communication with the tone chamber, the improvement therein in combination comprising:

the window extending a substantial portion of the one side;

the window being covered by at least approximately 70% of the reed such that said length of the reed interfaces with the tone chamber;

the means for holding the reed on the mouthpiece being a ligature; and the reed having an underside, a heel and lateral edges on the heel; the ligature having a body extending around the mouthpiece and a means for adjusting the body thereabout to secure the reed to the mouthpiece, the ligature being mounted on the reed such that the adjusting means is adjacent to the reed, such that the ligature applies pressure only to the lateral edges of the heel of the reed, and such that a predominant portion of the underside of the reed is unconstrained from vibration and is in contact with the vibrating air in the tone chamber of the mouthpiece, thereby increasing interchange of acoustic energy between the tone chamber and the heel of the reed.

21. The improvement of claim 20, further comprising the mouthpiece having a rear portion, the rear portion having a bore therein; and means for the tone chamber to communicate with the bore such that the transition therebetween is devoid of abrupt discontinuities.

22. The improvement of claim 21, wherein the means for communication between the tone chamber and the bore is a spoon shaped cavity.

* * * * *